United States Patent [19]

Custer

[11] Patent Number: 4,739,135

[45] Date of Patent: Apr. 19, 1988

[54] ATTITUDE INSENSITIVE AUTOMATIC RESET FLOW SENSOR

[75] Inventor: Craig S. Custer, Pompano Beach, Fla.

[73] Assignee: CTE Chem Tech Equipment Corp., Deerfield Beach, Fla.

[21] Appl. No.: 45,979

[22] Filed: May 4, 1987

[51] Int. Cl.[4] ..... H01H 35/40

[52] U.S. Cl. ..... 200/81.9 M; 200/82 E; 335/205

[58] Field of Search ..... 335/153, 205, 207; 200/81.9, 81.9 M, 82 E

[56] References Cited

U.S. PATENT DOCUMENTS 3,967,224 6/1976 Seeley ..... 335/153 X 4,126,841 11/1978 Maeno ..... 335/153

*Primary Examiner*—George Harris

*Attorney, Agent, or Firm*—Melvin K. Silverman

[57] ABSTRACT

Disclosed is a non-position sensitive, non-memory condition sensitive, automatic reset flow sensor having a solid housing having an inlet port and an outlet port connected by an axial bore through the center of the sensor housing. An armature is free to move axially within the bore within a range of motion defined by two pairs of detents, the detents extending radially toward the center axis of the bore. The magnetic axis of the compensating magnet is such as to normally oppose the magnetic axis of the armature and, thereby, to apply a magnetic repulsion against the armature to bias the armature toward the inlet port of the sensor housing. The force of magnetic repulsion between the compensating magnet and the armature is, at all times, greater than the force of gravity to, thusly insure that the repulsive force of the compensating magnet will be capable of returning the armature to its original position proximal to the inlet port detents, after the flow condition causing movement of the armature toward the outlet port detents has abated.

8 Claims, 1 Drawing Sheet

ATTITUDE INSENSITIVE AUTOMATIC RESET FLOW SENSOR

BACKGROUND OF THE INVENTION

Field of the Invention

The present invention relates to flow sensors and, more particularly, to non-position sensitive and non-memory condition sensitive flow sensors.

The prior art, as best known to the inventor, is reflected in U.S. Pat. Nos. 3,327,079 (1967) to Widel, entitled Magnetically Operated Electric Switch; 3,766,779 (1973) to Hoffman, entitled Hydraulic Responsive Device; 4,081,635 (1978) to Moore, entitled Electrical Switch Responsive to a Pre-Determined Fluid Flow; and 4,130,745 (1978) to Hezter, entitled Differential Pressure Threshold Detector.

None of the above, nor other prior art known to the inventor, discloses an Automatic Reset Flow Sensor which is both nonposition sensitive and non-memory condition sensitive.

A device having such characteristics is desirable for use in applications in which the sensor is likely to be subjected to varying orientations relative to the gravity vectory and wherein the obtaining of a reliable reset function, and the monitoring thereof to an outside control panel or the like, is of the utmost importance.

It is, accordingly, to such needs and shortcomings in the prior art that the present invention is directed.

SUMMARY OF THE INVENTION

The present invention comprises a non-position sensitive, non-memory condition sensitive, automatic reset flow sensor having a solid housing having, an inlet port and an outlet port comprising the input and output of an axial bore through the center of said sensor body. There is disposed within said axial bore an armature having an axis of magnetic polarity co-axial with the axis of said bore. Said armature is free to move axially within said bore within a range of motion defined by two pairs of detents, the detents extending radially toward the center axis of said bore. There is further provided a compensating magnet disposed within the sensor housing parallel to the axis of said housing but at a radius from said axis of the bore greater than the radius of said bore. The magnetic axis of said compensating magnet is such as to normally oppose the magnetic axis of said armature and, thereby, to apply a force of magnetic repulsion against said armature to thereby bias said magnetic armature toward said inlet port of the sensor housing. The axial position of said compensating magnet is externally adjustable such that said force of repulsion between said compensating magnet and said armature will become greater as the axial position of said compensating magnet is selectively advanced in the direction of the armature. The force of magnetic repulsion between said compensating magnet and armature is, at all times, greater than the force of gravity in order to, thereby, insure that the magnetic force of said compensating magnet will be capable of returning said armature to its original position proximal to the inlet port detents, after the flow condition causing movement of the armature toward the outlet port detents has abated. There is further provided a read switch in magnetic proximity to said armature such that the position and status of the armature may be electromechanically monitored.

It is, accordingly, an object of the present invention to provide an attitude insensitive flow sensor of the automatic reset type.

It is a further object to provide a non-memory condition sensor of the above type.

It is another object to provide a sensor having a high reliability of reset regardless of the attitude thereof.

It is yet a further object to provide a flow sensor of the above type wherein the setpoint thereof may be calibrated over a wide variety of flow values.

The above and yet other objects and advantages of the present invention will become apparent from the hereinafter set forth Detailed Description of the Invention, the Drawings, and Claims appended herewith.

DETAILED DESCRIPTION OF THE INVENTION

Figure 1:
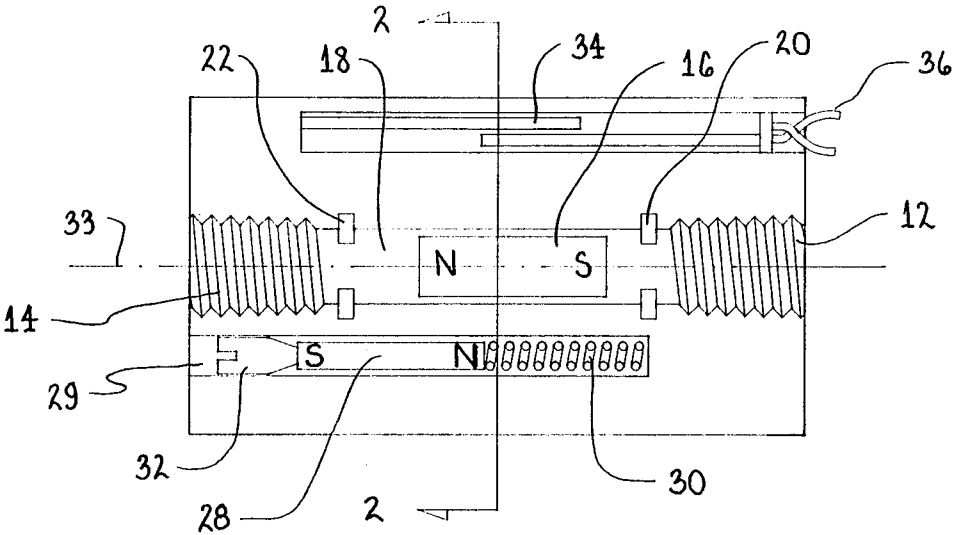
FIG. 1 is an axial cross-sectional view of the inventive flow sensor.

With reference to the view of FIG. 1, there is shown a sensor body 10 having an inlet port 12 and an outlet port 14, which ports are in integral communication through axial bore 18 of said sensor body 10.

Disposed with said axial bore 18 is an armature 16 (see also FIG. 2) having a diameter slightly less than the interior diameter of said axial bore 18.

As may be noted in FIG. 1, said armature 16 is provided with a magnetic axis having the north pole thereof at one end thereof and the south pole thereof at the opposite end of said armature 16. The geometry of armature 16 is more fully shown in the radial cross-sectional view of FIG. 2 in which one may note flat surfaces 24 of armature 16 and, as well, an annular clearance 26 between the outer surface of armature 16 and the interior diameter of axial bore 18, Further provided within axial bore 18 are axial motion detents 20 at the inlet side of said sensor and detents 22 at the outlet side thereof. The function of the said detents 20 and 22 is to limit, in each direction, the possible axial movement of armature 16.

With further reference to FIG. 1, there is shown, below said axial bore 18, a compensating magnet 28 secured within an axial bore 29. Said compensating magnet is provided with a magnetic polarity in which the north pole thereof is directed toward the inlet port of the sensor body, while the south pole thereof is directed toward the outlet port thereof. As may be noted in FIG. 1, said compensating magnet abutts a spring 30 which, in mechanical co-action with external adjustment means 32, enables one to externally regulate the axial position of compensating magnet 28 relative to axial bore 18 and armature 16.

As may be appreciated, the magnetic polarities of armature 16 and compensating magnet 28 are in opposition to each other such that the magnetic force of compensating magnet 28 will normally force armature 16 in the direction of inlet port 12. In a preferred embodiment, the magnetic strength of compensating magnet 28 will be greater than the force of gravity such that the tendency of such compensating magnet 28 to bias armature 16 to inlet side detents 20 will continue regardless of the orientation of sensor body 10 relative to the gravity vector. That is, compensating magnet 28 will possess adequate magnetic strength to force armature 16 into a reset position, in abuttment at or near inlet port detents 20, regardless of the orientation of the axis 33 of said sensor 10 relative to the gravity vector.

Figure 2:
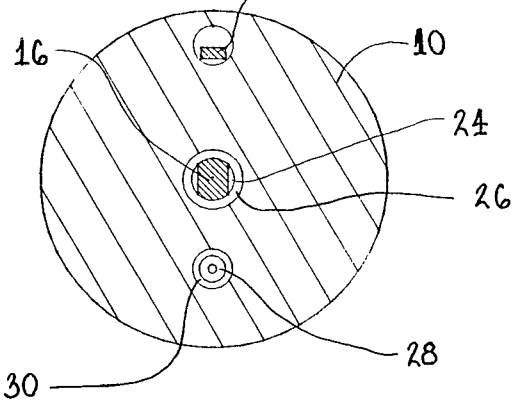
FIG. 2 is a radial cross-sectional view thereof taken along Line 2 of FIG. 1.

With reference to FIG. 2, it is to be appreciated that the geometry of said flat areas 24 of armature 16 represent one parameter which will determine the actuation point of armature 16, that is, the flow rate and volume at which armature 16 will displace to the left of FIG. 1 in the direction of outlet port detents 22. This actuation point is also known as the set point of the system.

Another parameter in determining the set point is the crosssectional area of annular clearance 26 between the interior diameter of sensor body 10 and armature 16.

A third parameter in determining the set point of the armature is the strength of the mutual repulsion between the magnetic axes of armature 16 and compensating magnet 28.

A fourth parameter in determining the set point is the axial position of compensating magnet 28 which, as above noted, is regulated by the rotation of external adjustment means 32.

The position of armature 16 is sensed by reed switch 34 which is situated within magnetic proximity thereof. That is, the condition of closure or non-closure of reed switch 34 will be governed by the axial position of armature 16 within axial bore 18. Element 36 represents an electrical output of the digital condition sensing effected by reed switch 34.

In view of the above, it may be appreciated that there is defined a non-position sensitive, non-memory condition sensitive, automatic reset flow sensor. It is, in this combination of functions and, as well, in the manner in which the above four parameters may be adjusted to set or change the set point of the system, that the objects of the present invention are obtained by the structure above set forth.

It is to be further appreciated that said compensating magnet 28 may take any forms which, for example, would include that of a ring magnet which would surround said axial bore 18.

Accordingly, while there have been shown and described the preferred embodiment of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

Having thus described my invention, what I claim as new, useful and non-obvious and, accordingly, secured by Letters Patent of the United States is:

1. A non-position, non-memory condition sensitive, automatic reset flow sensor, comprising:

(a) a solid housing having, a longitudinal axis thereof, an inlet port and an outlet port, said ports integrally connected by an axial bore through the center of said housing;

(b) an armature disposed within said axial bore, said armature having an axis of magnetic polarity coaxial with the axis of said bore, the armature being free to move longitudinally within said bore within a range of motion defined by two pairs of detents integrally extending radially from the interior diameter of said axial bore toward said longitudinal axis of said housing;

(c) compensating magnetic means disposed within said sensor housing, located at a radius from the longitudinal axis of said housing greater than the radius of the interior diameter of the said bore, said compensating magnet having a magnetic axis oriented to normally oppose the magnetic axis of said armature and, thereby, to apply to said armature a magnetically repulsive bias against said armature in the direction of said inlet port of the sensor housing, whereby the actuation point of said armature will be regulated by (i) the displacement between said compensating magnet and said armature in its unactuated position and (ii) the strength of the repulsive field between said magnets and, further whereby, said repulsive force between said magnets will assure the resetting of said armature to its original position after the flow condition causing actuation of the armature toward the outlet port has abated; and (d) the magnetic sensing means disposed within the magnetic proximity of said armature and within said sensor housing, wherein the position and status of said armature may be electromechanically monitored by said magnetic sensing means.

2. The flow sensor as recited in claim 1 in which said compensating magnet further comprises means for the external adjustment of the axial position of said compensating magnet relative to the rest position of said armature to thereby adjust the actuation point of said armature.

3. The sensor as recited in claim 2 in which said magnetic sensing means comprises a reed switch having its axis disposed parallel to the longitudinal axis of said sensor housing.

4. The sensor as recited in claim 1 in which said compensating magnetic means and said armature are provided with opposing pole magnets of sufficient strength such that the repulsion therebetween is greater than the force of gravity, thereby rendering the sensor attitude-insensitive.

5. The flow sensor as recited in claim 4 in which said compensating magnetic means further comprises means for the external adjustment of the axial position of said compensating magnet relative to the rest position of said armature to thereby adjust the actuation point of said armature.

6. The sensor as recited in claim 5 in which said magnetic sensing means comprises a reed switch having its axis disposed parallel to the longitudinal axis of said sensor housing.

7. The sensor as recited in claim 6 in which the longitudinal surface of said armature is provided with flat areas which, thereby, operate to change the actuation point of the armature as compared to the absence of such flat surfaces.

8. The sensor as recited in claim 1 in which said compensating magnetic means comprises a ring magnet.

* * * * *